US011131055B2

(12) United States Patent
Cooke et al.

(10) Patent No.: US 11,131,055 B2
(45) Date of Patent: Sep. 28, 2021

(54) METHODS AND SYSTEM FOR MONITORING AND REPLENISHING ONE OR MORE LAUNDRY COMPONENTS

(71) Applicant: Conopco, Inc., Englewood Cliffs, NJ (US)

(72) Inventors: Deborah Jane Cooke, Chester (GB); David Moorfield, Buckley (GB); Katharine Jane Shaw, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 444 days.

(21) Appl. No.: 16/150,872

(22) Filed: Oct. 3, 2018

(65) Prior Publication Data

US 2019/0264374 A1 Aug. 29, 2019

(51) Int. Cl.

| | |
|---|---|
| ***D06F 33/00*** | (2020.01) |
| ***D06F 34/28*** | (2020.01) |
| ***D06F 39/02*** | (2006.01) |
| ***D06F 39/08*** | (2006.01) |

(52) U.S. Cl.

CPC ..... *D06F 39/022* (2013.01); *D06F 33/00* (2013.01); *D06F 34/28* (2020.02); *D06F 39/02* (2013.01); *D06F 39/087* (2013.01); *D06F 2202/085* (2013.01); *D06F 2204/10* (2013.01)

(58) Field of Classification Search

None

See application file for complete search history.

(56) References Cited

U.S. PATENT DOCUMENTS

| | | | |
|---|---|---|---|
| 567,163 | A | 8/1896 | Pickens |
| 3,094,247 | A | 6/1963 | Marchi |
| 4,009,253 | A | 2/1977 | Schleppnik et al. |
| 4,187,251 | A | 2/1980 | Schleppnik |
| 4,719,105 | A | 1/1988 | Schleppnik |
| 4,932,227 | A | 6/1990 | Hogrefe |
| 5,441,727 | A | 8/1995 | Chatterjee et al. |
| 5,861,371 | A | 1/1999 | Wilsch-Irrgang |
| 5,897,671 | A | 4/1999 | Newman et al. |
| 5,942,485 | A | 8/1999 | Kemen |
| 5,974,303 | A | 10/1999 | Krause |
| 6,349,440 | B1 | 2/2002 | Amberg et al. |
| 8,631,972 | B2 | 1/2014 | Kessler et al. |
| 9,469,933 | B2 | 10/2016 | Miller |

(Continued)

FOREIGN PATENT DOCUMENTS

| | | |
|---|---|---|
| AU | 13548 | 9/1988 |
| CN | 1387563 | 12/2002 |

(Continued)

OTHER PUBLICATIONS

Co-pending U.S. Appl. No. 16/306,057; filed Nov. 30, 2018.

(Continued)

*Primary Examiner* — Levon J Shahinian

(74) *Attorney, Agent, or Firm* — Greenberg Traurig, LLP

(57) ABSTRACT

A method of supplying and replenishing a laundry dosing system with one or more reservoirs providing stocks of components for laundry includes monitoring consumption of each of the components in the one or more reservoirs; automatically determining when each one or more reservoirs need replenishment from the monitoring; and replenishing one or more components in response to a monitoring result.

4 Claims, 5 Drawing Sheets

(56) References Cited

U.S. PATENT DOCUMENTS

| | | | | |
|---|---|---|---|---|
| 9,949,612 | B2 | 4/2018 | Lonski | |
| 10,240,274 | B2 | 3/2019 | Miller | |
| 2001/0049846 | A1 | 12/2001 | Guzzi et al. | |
| 2002/0077265 | A1 | 6/2002 | Buzzacarini et al. | |
| 2003/0075237 | A1 | 4/2003 | Bettiol et al. | |
| 2003/0154560 | A1 | 8/2003 | Behrens et al. | |
| 2003/0216274 | A1 | 11/2003 | Del Duca et al. | |
| 2004/0147416 | A1 | 7/2004 | Woo | |
| 2005/0033647 | A1 | 2/2005 | Crisp, III | |
| 2005/0102767 | A1 | 5/2005 | Aouad et al. | |
| 2005/0106192 | A1 | 5/2005 | Parekh et al. | |
| 2005/0113282 | A1 | 5/2005 | Parekh et al. | |
| 2005/0150260 | A1* | 7/2005 | Marone | D06F 39/022 68/17 R |
| 2006/0102656 | A1 | 5/2006 | Troost et al. | |
| 2006/0138169 | A1 | 6/2006 | Cafferty | |
| 2006/0272360 | A1 | 12/2006 | Hsu et al. | |
| 2007/0044820 | A1 | 3/2007 | Chan et al. | |
| 2008/0276655 | A1 | 11/2008 | Luckman et al. | |
| 2008/0276964 | A1 | 11/2008 | Hendrickson et al. | |
| 2008/0276965 | A1 | 11/2008 | Aykroyd et al. | |
| 2009/0044129 | A1 | 2/2009 | Ebrom et al. | |
| 2009/0044137 | A1 | 2/2009 | Bartley et al. | |
| 2009/0194562 | A1 | 8/2009 | Kessler et al. | |
| 2009/0276101 | A1 | 11/2009 | Yankee et al. | |
| 2010/0102076 | A1 | 4/2010 | Hendrickson et al. | |
| 2010/0102082 | A1 | 4/2010 | Ebrom et al. | |
| 2010/0163573 | A1 | 7/2010 | Wegelin et al. | |
| 2011/0139818 | A1 | 6/2011 | Kessler et al. | |
| 2011/0154864 | A1 | 6/2011 | Schulze | |
| 2011/0174346 | A1 | 7/2011 | Kessler et al. | |
| 2011/0290281 | A1 | 12/2011 | Kessler et al. | |
| 2011/0315709 | A1 | 12/2011 | Fileccia et al. | |
| 2012/0015858 | A1 | 1/2012 | Kessler et al. | |
| 2012/0018451 | A1 | 1/2012 | Fileccia | |
| 2012/0021965 | A1 | 1/2012 | Bastigkeit et al. | |
| 2012/0031930 | A1 | 2/2012 | Feliccia et al. | |
| 2012/0056827 | A1 | 3/2012 | Kim et al. | |
| 2012/0088710 | A1 | 4/2012 | Kessler et al. | |
| 2012/0204356 | A1 | 8/2012 | Bastigkeit et al. | |
| 2012/0247158 | A1 | 10/2012 | Ditze et al. | |
| 2012/0088709 | A1 | 12/2012 | Kessler et al. | |
| 2013/0036775 | A1 | 2/2013 | Brueckner et al. | |
| 2013/0042652 | A1 | 2/2013 | Brueckner et al. | |
| 2013/0061404 | A1 | 3/2013 | Jenkins | |
| 2013/0175293 | A1 | 7/2013 | Burgess | |
| 2013/0263387 | A1 | 10/2013 | Aykroyd et al. | |
| 2013/0263630 | A1 | 10/2013 | Doh et al. | |
| 2013/0340178 | A1 | 12/2013 | Riesenberg et al. | |
| 2014/0102153 | A1 | 4/2014 | Lee et al. | |
| 2015/0330013 | A1 | 11/2015 | Miller | |
| 2015/0368846 | A1 | 12/2015 | Del Pos et al. | |
| 2015/0375900 | A1 | 12/2015 | Larson | |
| 2016/0060800 | A1 | 3/2016 | Ghosh et al. | |
| 2016/0289883 | A1 | 10/2016 | Lv et al. | |
| 2017/0048325 | A1* | 2/2017 | Tincher | H04L 67/306 |
| 2017/0081616 | A1 | 3/2017 | Baltsen et al. | |
| 2017/0107658 | A1 | 4/2017 | Bolton et al. | |
| 2017/0292217 | A1 | 10/2017 | Kulkarni | |
| 2018/0171531 | A1 | 6/2018 | Miller | |
| 2019/0136162 | A1 | 5/2019 | Cooke et al. | |
| 2019/0136439 | A1 | 5/2019 | Cooke | |
| 2019/0136440 | A1 | 5/2019 | Clarke | |
| 2019/0264364 | A1 | 8/2019 | Chatfield | |
| 2019/0292710 | A1 | 9/2019 | Cooke | |

FOREIGN PATENT DOCUMENTS

| | | |
|---|---|---|
| CN | 1401030 | 3/2003 |
| CN | 101302697 | 11/2008 |
| CN | 101302700 | 11/2008 |
| CN | 101886323 | 11/2010 |
| CN | 101886324 | 11/2010 |
| CN | 102571129 | 7/2012 |
| CN | 102883645 | 1/2013 |
| CN | 202744828 | 2/2013 |
| CN | 103485122 | 1/2014 |
| CN | 103726273 | 4/2014 |
| CN | 103924415 | 7/2014 |
| CN | 204211975 | 3/2015 |
| CN | 104652098 | 5/2015 |
| CN | 105143543 | 12/2015 |
| CN | 205258897 | 5/2016 |
| CN | 106192308 | 12/2016 |
| DE | 744406 | 1/1944 |
| DE | 102007041643 | 3/2009 |
| DE | 102008047941 | 3/2010 |
| DE | 102008053312 | 4/2010 |
| DE | 10201003776 | 10/2011 |
| DE | 102010027991 | 10/2011 |
| DE | 102010028353 | 11/2011 |
| DE | 102010027993 | 5/2012 |
| DE | 102013018175 | 6/2015 |
| DE | 102016212981 | 1/2018 |
| DE | 102016212982 | 1/2018 |
| EP | 0299575 | 1/1989 |
| EP | 0368680 | 5/1990 |
| EP | 0387426 | 9/1990 |
| EP | 1041187 | 10/2000 |
| EP | 1088927 | 4/2001 |
| EP | 1317524 | 6/2003 |
| EP | 1318225 | 6/2003 |
| EP | 1468926 | 10/2004 |
| EP | 1212398 | 6/2006 |
| EP | 1728912 | 12/2006 |
| EP | 1990461 | 11/2008 |
| EP | 1995368 | 11/2008 |
| EP | 2065860 | 6/2009 |
| EP | 2141275 | 1/2010 |
| EP | 2314542 | 4/2011 |
| EP | 2642013 | 9/2013 |
| EP | 2913431 | 9/2015 |
| EP | 2939975 | 11/2015 |
| EP | 2955150 | 12/2015 |
| EP | 3130968 | 2/2017 |
| EP | 3176298 | 6/2017 |
| FR | 2612894 | 9/1998 |
| GB | 2437555 | 9/2008 |
| GB | 2468158 | 9/2010 |
| GB | 2581486 | 4/2013 |
| GB | WO2017176292 | 10/2017 |
| GB | WO2017205280 | 11/2017 |
| KR | 20100081221 | 7/2010 |
| UG | WO0196645 | 12/2001 |
| WO | WO9115623 | 10/1991 |
| WO | WO9527037 | 10/1995 |
| WO | WO9709406 | 3/1997 |
| WO | WO0107095 | 2/2001 |
| WO | WO0208371 | 1/2002 |
| WO | WO0220893 | 3/2002 |
| WO | WO2004101122 | 11/2004 |
| WO | WO2008008392 | 1/2008 |
| WO | WO2008016683 | 2/2008 |
| WO | WO2008074680 | 10/2008 |
| WO | WO2009022223 | 2/2009 |
| WO | WO2009033828 | 3/2009 |
| WO | WO2009094999 | 8/2009 |
| WO | WO2009095003 | 8/2009 |
| WO | WO2009117795 | 10/2009 |
| WO | WO2009153184 | 12/2009 |
| WO | WO2010007054 | 1/2010 |
| WO | WO2010031607 | 3/2010 |
| WO | WO2010067303 | 7/2010 |
| WO | WO2011042867 | 4/2011 |
| WO | 102009046546 | 5/2011 |
| WO | WO2011128676 | 10/2011 |
| WO | WO2011131256 | 10/2011 |
| WO | WO2011134690 | 11/2011 |
| WO | WO2011138218 | 11/2011 |
| WO | WO2012084005 | 6/2012 |
| WO | WO2012118285 | 9/2012 |
| WO | WO2013054089 | 4/2013 |
| WO | WO2014031753 | 2/2014 |

(56) References Cited

FOREIGN PATENT DOCUMENTS

| | | |
|---|---|---|
| WO | WO2014079621 | 5/2014 |
| WO | WO2016173679 | 11/2016 |
| WO | WO2017042087 | 3/2017 |
| WO | WO2017067936 | 4/2017 |
| WO | WO2017211698 | 12/2017 |
| WO | WO2017211700 | 12/2017 |
| WO | WO2017211701 | 12/2017 |
| WO | WO2018011167 | 1/2018 |
| WO | WO2018011179 | 1/2018 |

OTHER PUBLICATIONS

Co-pending U.S. Appl. No. 16/306,067; filed Nov. 30, 2018.
Co-pending U.S. Appl. No. 16/306,082; filed Nov. 30, 2018.
Co-pending U.S. Appl. No. 16/306,087; filed Nov. 30, 2018.
Co-pending U.S. Appl. No. 16/306,099; filed Nov. 30, 2018.
Spruce App; Spruce App; 2019; pp. 1-12 (https://www.thespruce.com/there-is-an-app-for-laundry- 2146366).
Clorox My Stain App; Clorox My Stain App; 2020; pp. 1-3 https://play.google.com/store/apps/details?id=net.clorox2.mystain&hl=en_US.
Apps for Dry Clearners; Apps for Dry Cleaners; 2020; pp. 1-2, dlionline.org/apps.
VeryWear App STAIN; VeryWear App STAIN; 2020; pp. 1-4, https://appadvice.com/app/the-stain/510901231.
AEG, My AEG Care App; AEG, My AEG Care App; 2020; pp. 1-10, https://www.aeg.co.uk/about-aeg/connectivity-hub/#732729.
Hoover, Hoover Wizard App; Hoover, Hoover Wizard App; 2020; pp. 1-6, http://www.hooveronetouch.com/gb/index.html.
Candy Smart Touch App; Candy Smart Touch App; 2020; https://www.candysmarttouch.com/eu/index.html.
Samsung, SmartThings Classic App; Samsung, SmartThings Classic App; 2020; https://play.google.com/store/apps/details?id=com.smartthings.android&hl=en.
IPRP2 in PCTEP2019054368; Jun. 23, 2020.
Written Opinion 2 in PCTEP2018075459; dated Aug. 26, 2019.
IPRP2 in PCTEP2018075452; Jan. 10, 2020.
Written Opinion for PCTEP2018075452; dated Sep. 19, 2019.
Written Opinion 2 PCTEP2019054368.; dated Jan. 24, 2020.
Search Report and Written Opinion in PCTEP2018075452; dated Jan. 2, 2019.
Search Report and Written Opinion in EP17152544; dated Jul. 31, 2017.
Search Report and Written Opinion in EP16173798; dated Nov. 24, 2016.
IPRP in PCTEP2017063404; dated Oct. 10, 2018.
Search Report and Written Opinion in PCTEP2018076258; dated Nov. 6, 2018.
Search Report and Written Opinion in EP17194986; dated Apr. 19, 2018.
IPRP2 in PCTEP2017063403; Aug. 10, 2018.
Search Report and Written Opinion in PCTEP2017063403; dated Aug. 23, 2017.
Search Report and Written Opinion in EP16173806; dated Dec. 19, 2016.
Written Opinion 2 in PCTEP2017063404; dated Apr. 18, 2018.
IPRP2 in PCTEP2017063405; Sep. 20, 2018.
Search Report 2 and Written Opinion 2 in PCTEP2018050562; dated Jul. 4, 2018; World Intellectual Property Org. (WIPO).
IPRP in PCTEP2017063402; dated Sep. 24, 2018.
Written Opinion 2 in PCTEP2018050562; dated Jan. 10, 2019.
Search Report and Written Opinion in EP18162886.
Written Opinion in PCTEP2019052151; dated Jan. 14, 2020.
Written Opinion in PCTEP2019052152; dated Jan. 17, 2020.
IPRP2 in PCTEP2019052151; May 14, 2020.
IPRP2 in PCTEP2019052152; May 27, 2020.
Search Report and Written Opinion in PCTPE2019054368; dated Apr. 23, 2019.
Search Report and Written Opinion in PCTEP2019054368; dated Apr. 23, 2019.
Search Report and Written Opinion in PCTEP2019052152; dated Mar. 29, 2019.
Search Report and Written Opinion in PCTEP2018075439; dated Nov. 27, 2018.
Search Report and Written Opinion in PCTEP2018075459; dated Nov. 27, 2018.
Search Report and Written Opinion in PTEP2018076486; dated Nov. 6, 2018.
Search Report and Written opinion in EP18155012.
Search Report and Written Opinion in EP17206467.
Search Report and Written Opinion in PCTEP2017072935; dated Nov. 16, 2017.
Search Report and Written Opinion in EP16193266; dated Mar. 29, 2017.
Search Report and Written Opinion in EP17194249; dated Mar. 26, 2018.
Search Report and Written Opinion in EP17194201; dated Mar. 9, 2018.
Search Report and Written Opinion in EP16173793; dated Dec. 9, 2016.
Search Report and Written Opinion in PCTEP2017063402; dated Sep. 4, 2017.
Search Report and Written Opinion in EP16173811; dated Nov. 28, 2016.
Search Report and Written Opinion in PCTEP2017063401; dated Aug. 31, 2017.
Search Report & Written Opinion in PCTEP2017063404; dated Aug. 3, 2017.
Written Opinion 3 in PCTEP2017063404; dated Aug. 16, 2018.
Written Opinion in PCTEP2017063405; dated May 17, 2018; World Intellectual Property Org. (WIPO).
Search Report and Written Opinion in PCTEP2017063405; dated Jul. 25, 2017.
Search Report and Written Opinion in EP17152439; dated Jul. 17, 2017.
Search Report and Written Opinion in PCTEP2018050562; dated May 11, 2018; Partial Search Report.
IPRP2 in PCTEP2017063401; Jul. 23, 2018.
IPRP in PCTEP2017063404; Oct. 10, 2018.
IPRP in PCTEP2017063402; Sep. 24, 2018.
IPRP2 in PCTEP2019050562; May 15, 2019.
Search Report and Written Opinion in PCTEP2019052151; dated Mar. 29, 2019.
Search Report in Application No. GB1803058.5; dated Mar. 11, 2019.

* cited by examiner

METHODS AND SYSTEM FOR MONITORING AND REPLENISHING ONE OR MORE LAUNDRY COMPONENTS

The present invention relates to methods and systems for monitoring and replenishing one or more laundry components in laundry system.

Different fabrics may require various treatments depending on their type. Many user's wardrobes are becoming more complicated comprising a mix of formal wear/fashion items, 'technical' sports fabrics, more rugged garments (e.g., for gardening/cleaning), casual wear, soft baby clothes, children's uniforms and robust play clothing etc. On top of this fabric treatment possibilities vary according to usage, wear, cleanliness (soils, stains,) colour levels, etc. The situation is further complicated by consumer preferences (sensitivities, preference for biological or otherwise), such that no one laundry product is suitable for all situations.

Use of a single treatment product for all loads coming from the modern wardrobe, regardless of suitability, can mean that unnecessary treatment regimens and/or chemicals such as enzymes, bleaches etc. are used.

Further, there are many different possibilities of standard products to be used with laundry, including detergent, bleach, stain treatment, fabric softener, perfumes, wrinkle reduction treatment, static control treatment, etc. In typical laundry systems, each of these are bought separately and have to be separately applied at the wash time, a complicated and time-consuming process for users.

To avoid a user needing to dispense laundry components at every wash, some washing systems include auto-dosing, where a dose of one or more laundry products are provided for each wash. This saves the user time and does offer a more accurate dose for a specific wash. The auto-dose machines usually have reservoirs or removable cartridges that work specifically with that machine and are not interchangeable.

SUMMARY

According to a first aspect, a method of supplying and replenishing a laundry dosing system with one or more reservoirs providing one or more components for laundry comprises monitoring consumption of each of the one or more components in the one or more reservoirs; automatically determining when each one or more reservoirs need replenishment from the monitoring; and replenishing one or more components in response to a monitoring result.

Such a method can include one or more of the further steps: applying one or more monitoring devices to the one or more reservoirs; automatically ordering one or more components in response to a monitoring result; analyzing whether the amount of component in each of the one or more reservoirs is below a certain threshold amount, and generating a replenishment signal associated with a specific reservoir when the component in that reservoir is below the threshold amount; analyzing whether the amount of component in each of the one or more reservoirs is below a second threshold amount; and generating a replenishment signal associated with a specific reservoir when the component in that reservoir is below the second threshold amount with the second threshold amount set based on usage patterns of components; analyzing whether the component in each of the one or more reservoirs needs replenished based on expiration and/or contamination of the component or the reservoir, and generating a replenishment signal associated with a specific reservoir when the component in that reservoir is expired and/or the component or reservoir is contaminated; emptying the remaining components from the specific reservoir when the component in that reservoir is expired and/or the component or reservoir is contaminated; collecting, storing and/or analyzing data regarding usage of each component; and associating collected data with a user or household profile to analyze usage patterns and predict future replenishment needs.

According to a further aspect of the invention, a laundry system comprises one or more reservoirs providing one or more components for laundry products; one or more monitoring devices to monitor the component in each reservoir; and a processor that receives data from the one or more monitoring devices, analyzes the data, determines when a component needs replenishment, and generates a replenishment order associated with the component that needs replenishment.

According to further embodiments, the system comprises one or more of the following: that the processor further sends the replenishment order to a store where it is automatically purchased and sent to the location of the plurality of reservoirs; that the processor further determines if a component is expired and/or contaminated, and generates a replenishment order associated with any component that is expired or contaminated; that the one or more monitoring devices collects data on usage patterns of each component and sends the usage data to the processor; that the processor analyzes the usage data to predict replenishment rates; that the processor analyzes the usage data to recommend other products.

According to a third aspect of the invention, a system for automatically reordering one or more components for a laundry dosing system with one or more reservoirs of laundry components comprises comprising a non-transitory computer-readable medium that stores instructions that, when executed by a computer processor, cause the computer processor to: determine an amount of component in the one or more reservoirs; determine a component usage rate for each of the one or more reservoirs, wherein the component usage rate is proportional to an amount of component used per unit time;

determine a time-to-exhaustion for each of the one or more reservoirs considering the amount of component in each of the one or more reservoirs and the component usage rate for each of the one or more reservoirs; and when the time-to-exhaustion for a reservoir drops below a threshold, request an order of the component associated with that reservoir. Optionally, the component being requested ordered is automatically sent to the location of the one or more reservoirs.

According to a fourth aspect of the invention, a reservoir with an internal chamber for storing one or more laundry components comprises a monitoring device for monitoring one or more properties related to the internal storage chamber or components therein; a controller for communicating with a remote system; and a connector for fluidly and controllably connecting the reservoir to a washing machine. The reservoir can optionally further include a power source for the controller. Further optionally, the controller is removable from the reservoir.

BRIEF DESCRIPTION OF THE DRAWINGS

Various non-limiting embodiments of the present invention will now be described by way of example only and with reference to the following drawings in which.

DETAILED DESCRIPTION

Figure 1A:
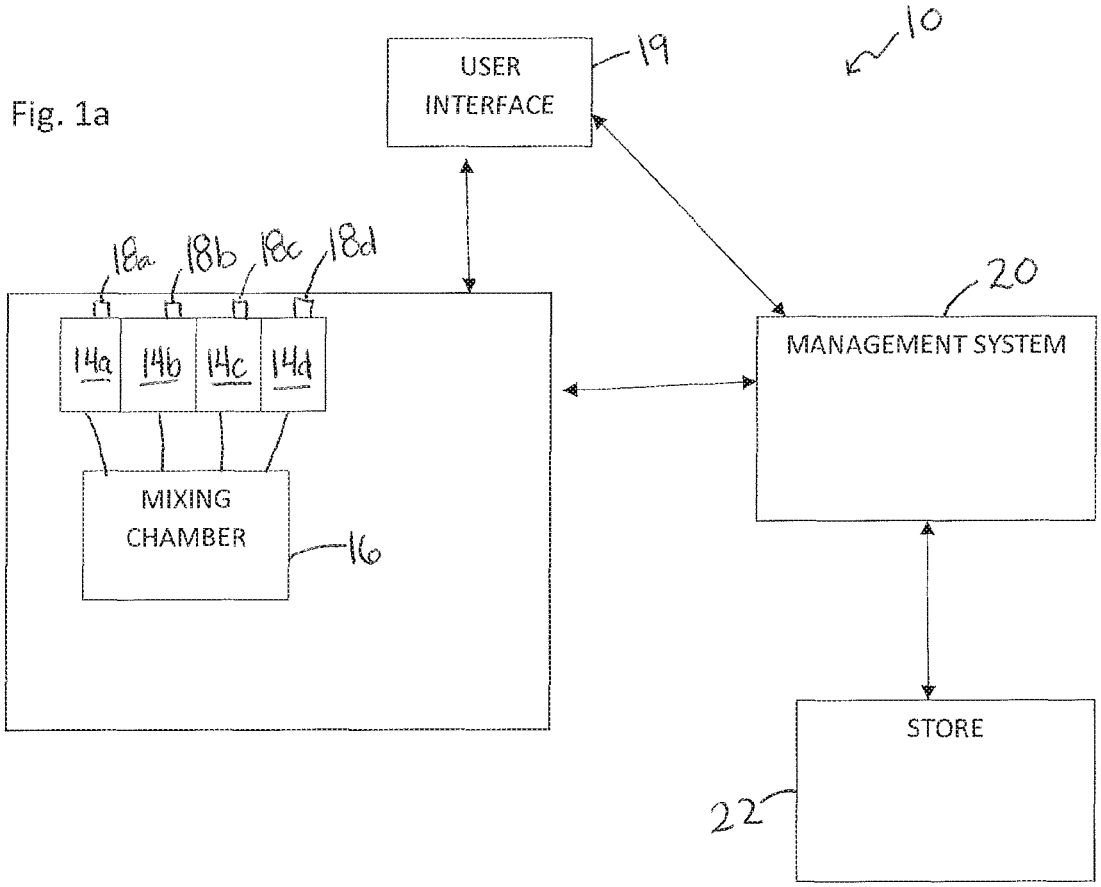
FIG. 1*a* is a schematic illustration of a laundry system.

When providing specialized laundry systems; for example, systems which can provide a number of different components to a wash, automatically dose components and/or mix components; a number of different reservoirs can be used to store stock of the components. The stock can be segregated, or in some cases a few components are stored in one reservoir, for example, a main liquid stock and a single dose pod. The components are used at different rates and need to be replenished periodically. In systems which are partially or fully automatic (e.g., the laundry system uses data and/or inputs to determine and/or dose laundry components or a bespoke recipe), a user can lose track of when components are running low and need replenishment. Further, with individualized laundry systems that have a large number of available components, it is time-consuming to keep track of and either go to the store or manually place an order for a component that needs replenishment. Often, especially in systems where there is little to no user engagement in the distributing of laundry products to an individual wash, a user is not alerted until a component or laundry product is completely depleted and then must wait to do more laundry until there is time to replenish through ordering and/or going to a store to buy more.

The current system aims to avoid these problems and others while allowing for a laundry system that can provide specific laundry products and therefore provide a specific wash which is appropriate for specific fabrics, loads, and/or users. This is done using systems and methods of monitoring one or more components in one or more reservoirs, determining when a replenishment is needed, and replenishing a component in response.

Such a system can be implemented using an Internet of Things (IoT) model, which uses a network of physical devices to connect and exchange data, allowing for monitoring and management through a network such as the Internet. When low levels in a particular reservoir of a component is sensed, a replenishment signal could be sent to remind a user to order a replacement or even automatically order a replenishment to be sent to the user. The monitoring and data exchanged could also be stored and analysed for further uses, for example, to predict when a replenishment is needed, group orders of components likely to run out at a similar time, monitor whether replenishment is needed due to expiration or contamination of a component, empty reservoirs where components are expired or contaminated, build a user or household profile, recommend other products, etc.

Specific embodiments of methods and systems could use a variety of different tags for the monitoring and communication, including active or passive tags associated with the component packaging or actual component itself, the reservoirs and/or a washing machine component. Tags can include data and/or metadata and a transmitting device to send signals to a reader or other system. The tag would have a unique identifier that is associate with a component and can be transmitted. The association can be set at a time or purchase, manufacture, filling, etc. Tag readers could, for example, be placed on a washer or on reservoirs for reading the tags of components and communicating that information to a management system. Different systems can be used, including but not limited to RFID tags and readers, QR codes and readers, Bluetooth, barcodes and readers, infrared, and near field communication. The following description and associated figures show and describe specific non-limiting embodiments of such systems and methods.

Figure 1B:
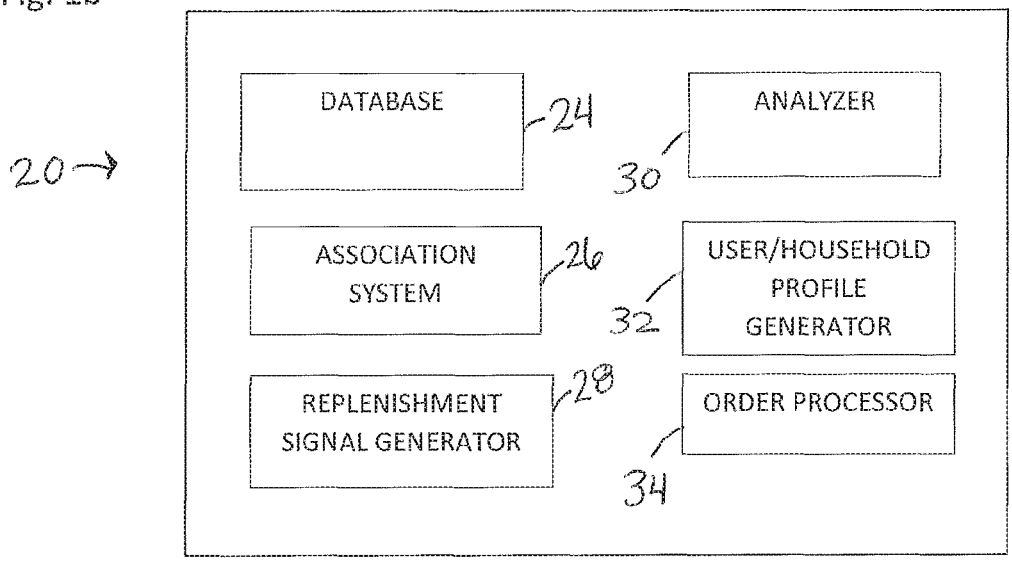
FIG. 1*b* is a schematic illustration of the management system of FIG. 1*a;*

FIG. 1*a* is a schematic illustration of a laundry system 10, which includes a wash machine 12, a plurality of reservoirs 14*a*-14*d*, mixing chamber 16, monitoring devices 18*a*-18*d*, user interface 19, management system 20 and product store 22. FIG. 1*b* shows a schematic illustration of management system 20, including database 24, association system 26, replenishment signal generator 28, analyzer 30, user/household profile generator 32, and order processor 34.

Laundry system 10 stores a plurality of different components in reservoirs 14*a*-14*d* which can be dispensed into a wash and/or combined to design a specific laundry product according to data associated with a particular load which is being washed. Such data can include stain identity data, fabric identity data, user preferences and/or user requirements. Details of such a laundry systems able to design and mix a laundry product from different components can be found in European patent application nos. 16173793.7 (titled PROVISION OF LAUNDRY PRODUCT and filed on Jun. 9, 2016); 16173798.6 (titled LAUNDRY PRODUCTS and filed on Jun. 9, 2016); 16173811.7 (titled PROVISION OF LAUNDRY PRODUCT and filed on Jun. 9, 2016); 17152439.0 (titled APPARATUS FOR PROVIDING LAUNDRY DETERGENT and filed Jan. 20, 2017), 17194986.0 (titled METHODS AND DEVICES FOR CALCULATING A LAUNDRY PRODUCT RECIPE and filed on Oct. 5, 2017); 17194249.3 (titled LAUNDRY PRODUCTS and filed Sep. 29, 2017); 17194201.4 (titled LAUNDRY LIQUID MIXING APPARATUS and filed Sep. 29, 2017); 17195035.5 (titled LAUNDRY PRODUCTS and filed Oct. 5, 2017); 17195038.9 (titled LAUNDRY PRODUCTS and filed Oct. 5, 2017); 17206467.7 (titled METHODS AND DEVICES FOR CALCULATING A LAUNDRY PRODUCT RECIPE and filed Dec. 11, 2017), each of which are hereby incorporated by reference.

According to the laundry product and/or recipe designed, wash machine 12 can dispense certain amounts of laundry components from one or more of reservoirs 14*a*-14*d* for washing. When mixing a bespoke recipe, the specific components are delivered to be mixed in mixing chamber 16, and then transported to be used for washing.

While four reservoirs 14*a*-14*d* are shown, this is for example purposes only, and system 10 could include more or fewer reservoirs, and more or fewer mixing chambers 16. Further, reservoirs 14*a*-14*d* and/or mixing chamber 16 could be located at other positions within washing machine or outside of washing machine 12 and simply be connectable to a washing machine or other device (see FIG. 4). In some embodiments, reservoirs 14*a*-14*d* could be fully or partially removable, and could be replaced with new reservoirs 14*a*-14*d* when depleted. Some embodiments could have a removable component or insert in place of reservoir (or to be inserted within reservoir), for example, a cartridge, refillable bottle or a deformable pouch. A deformable pouch or cartridge could allow use with a number of different machines. A refillable bottle could allow a consumer to refill the reservoir only periodically when a component is running out. The term reservoir is used broadly to encompass any sort of housing, permanent or disposable that can contain a laundry component and/or product. Thus, some embodiments could include a permanent reservoir for receiving a component, such as reservoir 14*a*; a reservoir of a single dose component in a reservoir that disintegrates in the wash to allow the component to be used; a reservoir which sits in the washing chamber to dispense a component from there for particular washes; or a combination of these.

User interface 19 can be located at wash machine 12, or could be a remote user interface, for example, displayed on a smart phone or a tablet. User interface 19 could be a graphical user interface that could show a variety of information to a user related to system 10 and components, for example, current or planned washes, representations of reservoir levels, estimated time or washes to expiration of reservoirs, etc.

User interface 19 could be used to input or associate certain components with certain reservoirs. Alternatively, a reader could be used to associate a particular component with a particular reservoir, or such associations could be made automatically, for example through monitoring devices 18*a*-18*d* sensing a component or tag on a component packaging, and that information being communicated to management system 20. Association could even be started at the time of purchase, with a specific reservoir being designated for a specific component and a communication (e.g., through the user interface 19) to the user of which reservoir 14*a*-14*d* into which a purchased component should be placed. This can be especially useful in systems where reservoirs 14*a*-14*d* are different sizes or otherwise have different characteristics that would make them more suitable for specific components.

Monitoring devices 18*a*-18*d* can be connected to reservoirs 14*a*-14*d* or incorporated into or near reservoirs, and are able to sense the amount of component in each reservoir 14*a*-14*d*. One monitoring device is associated with each reservoir in the embodiment shown, though this could vary in different embodiments. Sensing or monitoring can be through a number of different manners, for example, weight measurements, sensors measuring volume or flow, sensors measuring amount dispensed (with initial amount known or sensed), sensing the levels with a simple floating object which stays with the liquid levels, sensing air flow entering the reservoir as a result of fluid leaving, sensing through a light or acoustic signal, optical sensors, ultrasonic sensors, sonar sensors, etc. In some embodiments, monitoring devices 18*a*-18*d* could be removable for reuse with another reservoir, a feature particularly useful when reservoirs are disposable. Sensing or monitoring (and communicating the information to management device) can be done at certain intervals, for example time intervals such as once per hour or once per day, or could be done in relation to certain triggering events such as at the start of a wash cycle.

Monitoring devices 18*a*-18*d* could also sense and/or monitor a number of other things, for example, mass of stored laundry product content; a flow rate or other flow characteristic of laundry product egressing from the reservoir(s); presence of any stored content within the reservoir (s), the nature of the laundry product compositions within the internal reservoir(s), the chemical composition and/or components, the age or quality of the chemical composition and/or components, the origin or brand, or generally any physical or chemical property of the laundry product and/or components, or of ullage or vapour/gas in any head space above the laundry product, etc. These properties may be sensed directly, e.g. by direct detection of the physical and/or chemical properties, or by indirect sensing, such as reading a barcode or other product identification on a plug-in laundry product cartridge installed in the reservoir(s) or by reading/interfacing with a device or sensor installed within a cartridge, pouch or bottle itself. The sensing may therefore generally be active or passive for qualitative and/or quantitative sensing of mechanical, electrical, physical and/or chemical properties, which are conveyed as control signals.

Monitoring devices 18*a*-18*d* communicate with management device 20, which can be located at the site of washing machine 12 or away from washing machine 12. Management device 20 then knows what component is in which reservoir, and collects usage data on each specific component, monitoring the consumption of each component in each reservoir. In some embodiments, monitoring devices could include a power supply, for example, a battery or a rechargeable battery.

A threshold can be set (or determined automatically, for example, based on estimated usage per time) such that when the threshold is reached, a determination is made that a reservoir needs replenishment. This threshold could be a standard amount, for example, when only 10% of the component remains in the reservoir, or could vary by component, for example, the threshold is 15% for the heavily used component(s) in reservoir 14*a* but only 10% for the less used component(s) in reservoir 14*b*. Data received and stored (and analysed) in management system 20 can be used to determine and/or set threshold(s). For example, the data could be used to set a threshold according to historical use rate and the estimated length of time to replenishment once a replenishment signal has been generated or other data obtained and/or input.

When a determination that replenishment is needed in one or more reservoirs 14*a*-14*d*, a replenishment signal can be generated from management system 20. Such a signal could automatically place an order to product store 22 (or other source for obtaining the component) to send a replenishment amount of the particular component to the user or location where wash machine 12 is located. In other embodiments, the replenishment signal could send a reminder or a prefilled order to the user, for example, via email or the user interface such that the user merely has to confirm that the replenishment order should be placed.

In some embodiments, one or more further threshold signals can also be determined and/or set. This could related to levels or amounts that are different from the replenishment threshold but could trigger another signal, such as a replenishment signal anyway. For example, a second threshold could be set when a reservoir is down to only 20% product. If a different reservoir 14*a* hit the replenishment threshold, for example, 10% of component left, component b in reservoir 14*b* that was not yet at the replenishment threshold of 10% but was below the second threshold of 20% could be ordered with component a to replenish components a and b in reservoirs 14*a* and 14*b* for convenience of ordering and shipping. The second threshold could be set by a user or automatically, for example, based on usage patterns and an expected time-to-exhaustion. If using any of cartridges, refillable bottles or deformable pouches, any of these could also include sensors and/or monitoring devices which could communicate information regarding levels of component directly to the management device as well, and for which the management system could order a replenishment in the same manner as described above.

Management system 20 can be a computer system with a processor or any other type of suitable system for receiving, storing, processing and/or sending data. In some embodiments, management system 20 can be a distributed network of computers which communicate with each other. Management system 20 can include a number of different systems, including but not limited to database 24, association system 26, replenishment signal generator 28, analyzer 30, user/household profile generator 32 and order processor 34. Management system 20 could communicate with wash machine 12, monitoring devices 18*a*-18*d*, user interface 19 and/or store 22 to send and receive signals and/or data.

Data received from wash machine 12, and particularly monitoring devices 18*a*-18*d* can be used to determine a component usage rate from collected data and/or data from other users associated with other washing machines. Usage data rates can be used to determine a time-to-exhaustion for each reservoir, and use this data to set threshold for requesting or ordering particular components. The time-to-exhaustion is related to an amount of component used per unit of time. As different components are used at different rates by different users and households, the ability to determine threshold levels and replenishment components according to individual usage can ensure that components are always available for a washing cycle when needed. This can be done using the analyzer, database, user/household profile generator and/or other systems of management system 20. Additionally, it takes away the burden from a user having to consistently check levels of particular components and remember to order or buy them, as well as having to constantly buy and/or stock heavily used components.

Association system 26 can be related to associating particular components with particular reservoirs 14*a*-14*d*. Association system 26 can use one or more readers (as discussed above and in relation to monitoring devices 18*a*-18*d* and related sensing), user input (e.g., through user interface 19), be associated with point of purchase data being sent directly to management system, or any number of other ways which associates a particular component with a particular reservoir. Information could be checked periodically, for example, through monitoring devices 18*a*-18*d*, to ensure that components are properly associated with reservoirs 14*a*-14*d*.

A user and/or household profile can also be generated through user/household profile generator 32 of management system 20. This could be done, for example, by collecting usage data, determining usage and replenishment rates and associating such data with a particular user or the household. This could be used to predict, for example, when a particular component is likely to be used more and need replenishing faster. For example, when a user who has a lot of clothes which require washing with a special component goes away at regular intervals, management system can predict when household needs for that particular component will increase through historical use data, and set thresholds accordingly (e.g., different threshold levels for different time periods).

Such user or household profiles can also be used to suggest different or upgraded products which may be more suitable for particular washes or fabrics.

In some embodiments, management system 20 can be used to check whether a component is expired or contaminated. This could be done, for example, by receiving and storing expiration data, and then ordering a replenishment when the expiration date is approaching and possibly sending a signal to empty the current stock of the component when the expiration date arrives. In some embodiments monitoring devices 18*a*-18*d* could determine that a reservoir or component is contaminated and send a signal to the management system 20. The management system 20 could then, for example, immediately send a signal to empty that particular reservoir (if deemed safe) and automatically place an order for a replenishment amount of that component to be sent from the store 22 to the location of the wash machine 12. In some cases, the management system 20 may also alert the user to the contamination to let them know that component would not be available for washes until the replenishment arrives, for example, through the user interface 19 or from a message directly to a user's device such as a smartphone. These functions can be done using analyser 30, replenishment signal generator 28, order processor 34, database 24 and/or another signal generator. Management system 20 may also be able to automatically order replenishments when a manufacturer issues a recall for a specific product that the management system has associated with a specific reservoir.

The communication between management system 20 and store 22 (or other source for components) can vary depending on the retailer and can be done through order processor 34. In some embodiments, a user may have all payment and shipment information stored in management system 20 which allows management system to send an order and payment directly to store 22. Other systems may involve more user interaction, for example to input or check the shipping information and/or payment. Still other systems may involve automatic ordering by management system 20 but a user picking up the actual components from store 22 or another location after receiving a message that a replenishment order is ready.

By using monitoring devices 18*a*-18*d* associated with reservoirs 14*a*-14*d* (or cartridges/pouches/refillable bottles) and management system 20, laundry system 10 is able to accurately monitor levels of components available, and automatically determine when one or more need replenishment. Such a system can enable easier tracking and replenishment of components, taking away the mental burden of having to track and remember what needs bought, and the physical burden of placing and picking up an order for more of a specific component. Such a system can provide highly personalized laundry and decrease burdens on a user.

Figure 2:
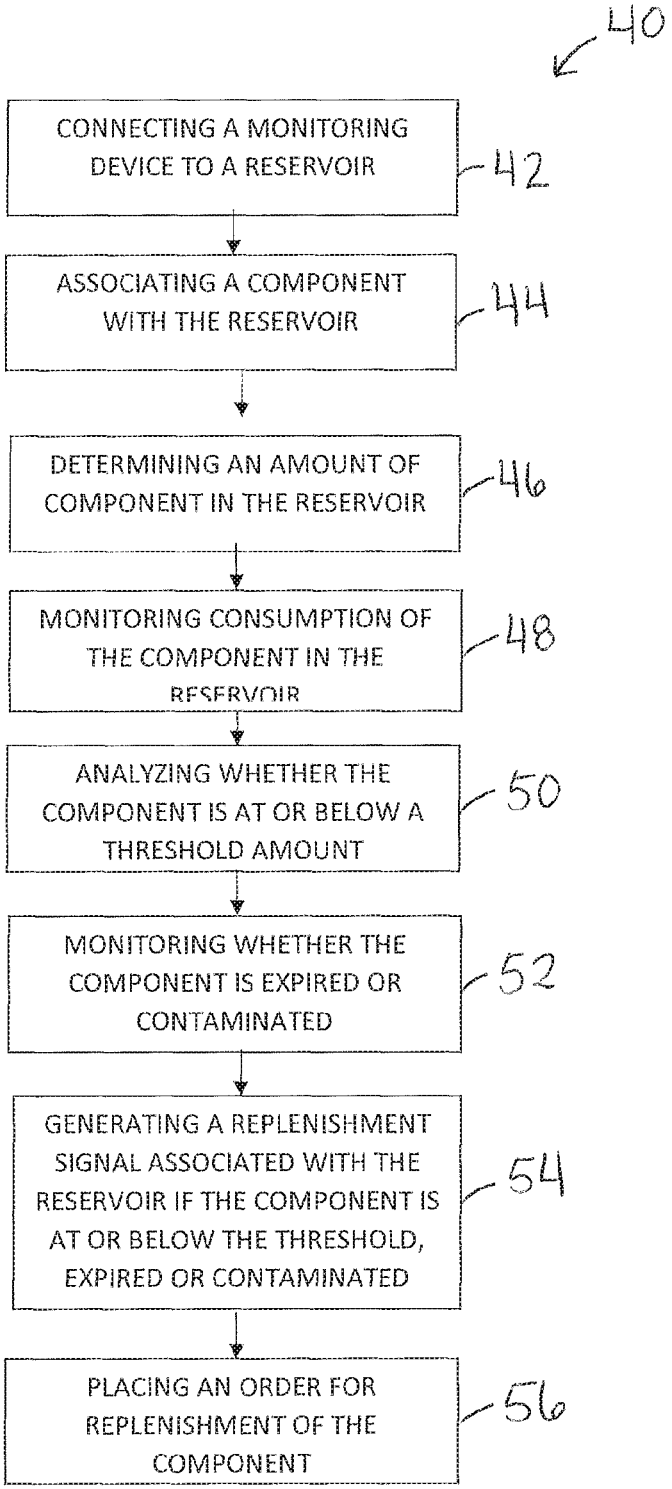
FIG. 2 is a flowchart of a method for replenishing a laundry system.

FIG. 2 is a flowchart of a method 40 for replenishing one or more components in a laundry system. Method 40 can be governed by instructions stored in a management system or elsewhere, and executed by a processor (e.g., within management system).

Method 40 includes connecting a monitoring device to a reservoir (step 42), associating a component with the reservoir (step 44), determining an amount of component in the reservoir (step 46), monitoring consumption of the component in the reservoir (step 48), analyzing whether the component is at or below a threshold ament (step 50), monitoring whether the component is expired or contaminated (step 52), generating a replenishment signal associated with the reservoir if the component is at or below the threshold, expired or contaminated (step 54), and placing an order for replenishment of the component (step 56).

Connecting a monitoring device to a reservoir, step 42, can be done in many ways depending on the monitoring device used, the reservoir used and the overall laundry system. In some embodiments, a monitoring device such as a sensor could be directly or indirectly connected to one or more reservoirs. In other embodiments, monitoring device could be built into the reservoir or washing machine. In further embodiments, monitoring device could be a reusable sensor which could be used in association with a number of reservoirs, and simply disconnected from a reservoir and reconnected to a new reservoir. This embodiment would be especially useful when the reservoir is disposable.

Associating a component with a reservoir, step 44, can be done in a number of ways discussed in relation to FIGS. 1*a*-1*b*. The association could use a number of different tags and readers or associating systems which communicate with management system 20 for storing the association data. This ensures that the one or more components in a specific reservoir are known to ensure that a correct signal for ordering a replenishment is generated when the time comes.

Determining the amount of component in a reservoir, step 46, can also be done in a number of ways, including but not limited to, weight measurements, sensors measuring volume or flow, sensors measuring amount dispensed (with initial amount known or sensed), sensing the levels with a simple floating object which stays with the liquid levels, sensing air flow entering the reservoir as a result of fluid leaving, sensing through a light or acoustic signal, optical sensors, ultrasonic sensors, sonar sensors, etc.

Monitoring consumption of the component in the reservoir, step 48, and analyzing whether the component is at or below a threshold amount, step 50, involves the monitoring and sensing discussed in relation to step 46. The monitoring and sensing allows for a determination of the amount of component in the reservoir, and the transfer of this data to management system 20. Management system 20 can receive, store and process this data to constantly monitor consumption of the component in the reservoir as washes are performed. This monitoring data can be used to generate user and/or household usage patterns, which could be used to set threshold levels (as discussed in relation to FIGS. 1*a*-1*b*).

Monitoring whether the component is expired or contaminated, step 52, is also done through the monitoring device and/or management system. Expiration dates could be known to the management system from the point of purchase, and a replenishment signal could be associated with the expiration date to automatically indicate that component needed replenishment by the expiration date and possibly automatically generate an empty signal for the reservoir on that date as well. Emptying could also involve a washing out or rinsing of the reservoir. Contamination could be determined through monitoring device which could signal to management system that the component is contaminated and should be emptied. The emptying could be done automatically, for example, through wash machine drainage system (if safe for the component and system) or could generate a signal to the user indicating that the contaminated component needed to be removed. Such an emptying for contamination could also generate an automatic cleaning of the reservoir or a reminder to a user that such cleaning is needed for a specific reservoir.

Generating a replenishment signal associated with the reservoir if the component is at or below a threshold, expired or contaminated, step 54, is done through management system 20. Such a signal could automatically lead to step 56 of placing an order for the replenishment component to be delivered. In other embodiments, the replenishment signal would simply generate an order, and prompt a user to indicate that the order should be placed, as discussed in relation to FIGS. 1*a*-1*b*.

Figure 3A:
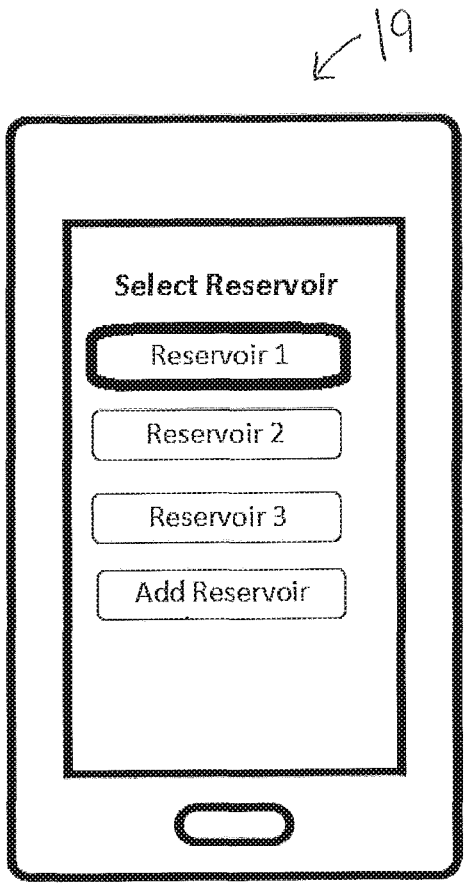
FIGS. 3*a*-3*c* shows an example user interface for a laundry system.
Figure 3B:
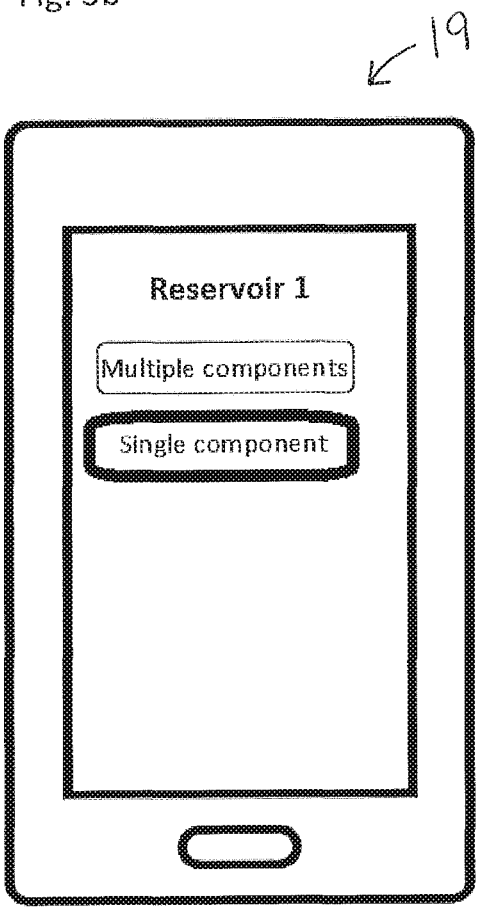
Figure 3C:
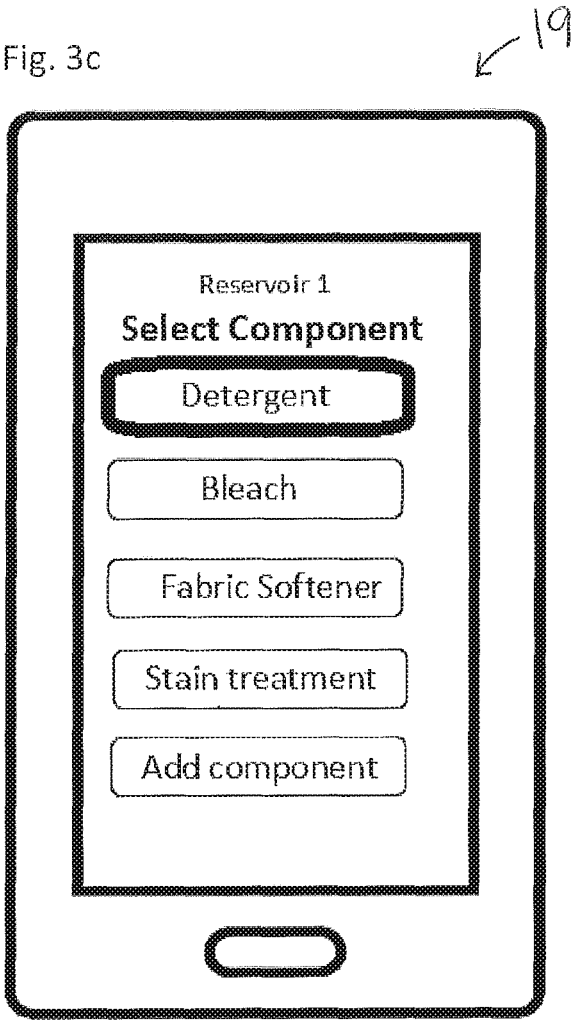

FIGS. 3*a*-3*c* show an example user interface 19 for laundry system 10, with the user interface 19 being used to associate components with reservoirs. User interface 19 is shown as a graphical user interface displayed on a smart phone or a tablet, but could be on another device, such as a smart home system, a washing machine input system, etc. The sequence shown to associate a component with a reservoir using interface 19 is for example purposes only, and the association sequence or input (if any) by a user could vary greatly.

FIG. 3*a* shows an initial screen listing all known reservoirs, which could be, for example, reservoirs which have been used before. An option is also shown to add a reservoir. This can be, for example, an external reservoir which is connectable to the washing machine (see FIG. 4), a reservoir which is added to the inside of the machine, a single use disposable pod reservoir, etc. As can be seen, in FIG. 3*a*, the user has selected Reservoir 1.

FIG. 3*b* shows a next screen after a selection of Reservoir 1. This screen shows options to add a single component or multiple components. In this case, the user selected a single component, though a selection of multiple components could, for example, take the user to a further process where the number of components and then type are each selected or input.

FIG. 3*c* shows a list of possible components that the user could select from after selecting a single component. This list could be compiled from various sources, for example, components which have been used in the past, components which were purchased, components which were scanned in with a reader, etc. A user could also select to add a component to manually input a specific component. The component list shown is for example purposes only, and actual components would vary greatly. In systems which a bespoke laundry composition is formed, the components would be parts of a bespoke recipe. Further, the generic components shown would likely be more specific to ensure that a correct association is made, and therefore a correct replenishment signal could be generated and/or sent for replenishment of a component.

User interface 19 of FIGS. 3*a*-3*c* shows an example graphical user interface which could be used in association with laundry system 10. Such a user interface would allow easy user interaction with system 10 to give a user control over the system as well as assurance that system 10 is working as intended.

Figure 4:
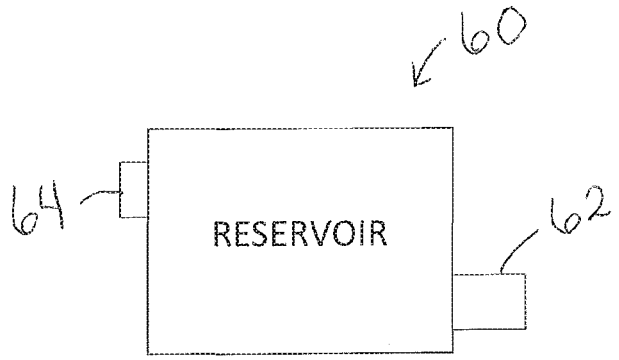
FIG. 4 shows an embodiment of a reservoir connectable to a washing machine.

FIG. 4 shows a laundry component reservoir 60, which can be connectable to a washing machine 12. Reservoir 60 includes connector 62 and controller 64. Reservoir 60 can be a cartridge, pouch or other shape that could fit inside or be placed outside of a washing machine or reservoir and hold one or more components for a laundry product. Reservoir 60 could even be a refillable bottle which could be used to manually fill reservoirs 14*a*-14*d* in some cases.

Connector 62 allows for the one or more components in the reservoir to be directed to a washing machine or other washing device. This can be either a direct connection, e.g., connector can dose directly into a washing machine interior, or indirectly, e.g., connector connects to tubing or a mixing chamber providing a fluid connection with a washing machine interior or other location where washing is to take place. In some embodiments connector 62 could be simply be a housing which fully or partially disintegrates when reservoir is in a washing chamber during a wash operation to allow a component into the wash. In other embodiments, the reservoir 60 is used to manually refill reservoirs such as those seen in FIG. 1.

Controller 64 can have many functions, including but not limited to, monitoring component levels in the reservoir, recognizing a component and/or reading a tag associated with the component, controlling dosing of the component, communicating with the washing machine and/or a management system. In some embodiments, controller 64 includes a power source, such as a battery so that reservoir does not need external connections for power. This could be especially useful when reservoir 60 is meant to be inserted into the drum of a washing machine for directly dosing a component or when reservoir is inserted into another reservoir, mixing chamber or other space within the washing machine.

In some embodiments, controller 64 can be removable such that reservoir 60 is disposed of (or recycled) while controller 64 can be saved by the user and connected to a replenishment reservoir. This can allow for a user to not have to handle component fluids which may be dangerous, e.g., bleach, and instead just have to replace a reservoir with another reservoir. This can also enable easy packaging for shipment of replenishments.

Such a reservoir 60 can be used as part of laundry system 10 and/or with method 40 to enable easy replenishment of components. By having a reservoir 60 which can be connectable to a washing device from the inside or outside, a more flexible system for dosing particular laundry components is enabled. Space can be freed up from inside the machine by locating reservoir outside of the machine, or in the actual drum. A user can easily insert or connect a replenishment reservoir when it is determined replenishment is needed (which may have been automatically ordered by management system). By allowing for universal connection, reservoir 60 can be used with a large number of different machines, enabling users to have more choice in what components and machines they can use without limiting washing options.

In some embodiments, reservoir 60 could be sent directly back to the supplier or another party for recycling. This could be as part of the automatic replenishment, for example, a packaging label could be sent with the replenishment, where the old reservoir can be simply placed into the box in which the replenishment reservoir came, and the package label applied to return the depleted reservoir (e.g., for washing and refilling by the supplier or another party). This would reduce waste associated with reservoirs.

Figure 5:
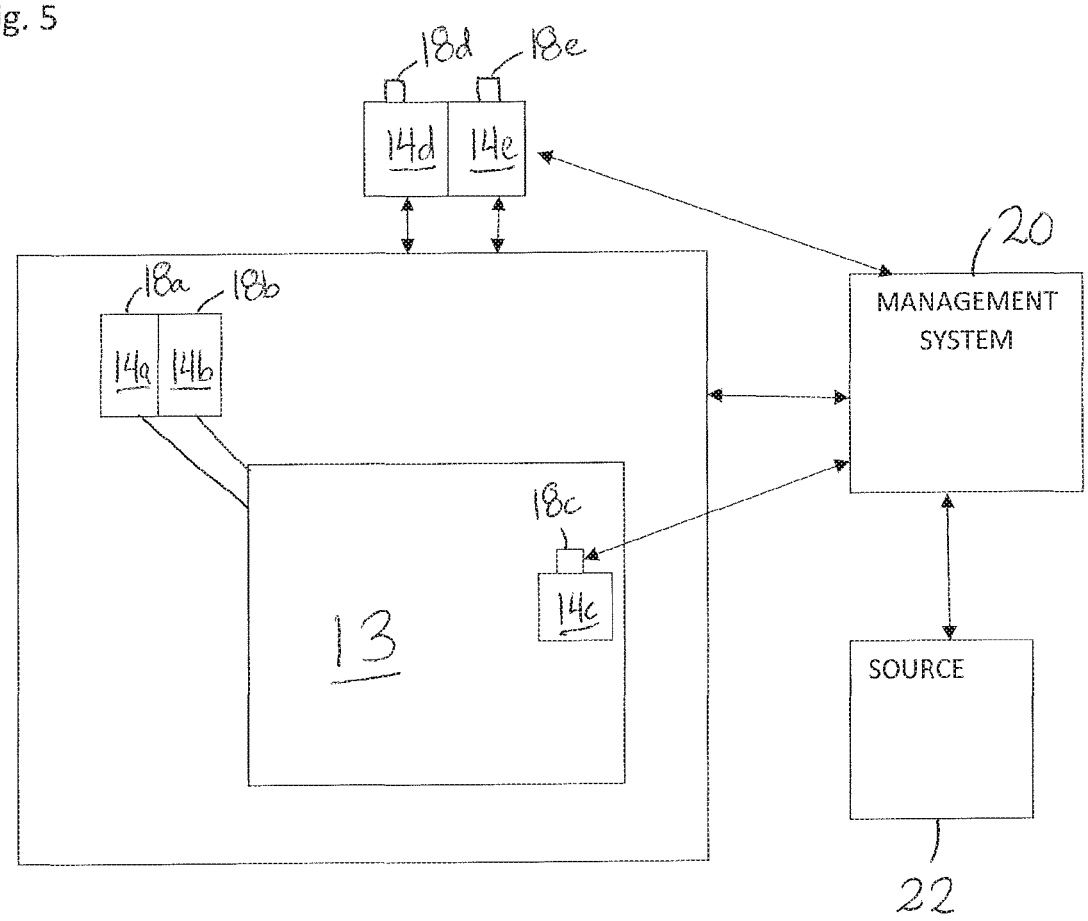
FIG. 5 shows a schematic further embodiment of a laundry system.

FIG. 5 shows a schematic further embodiment of a laundry system. Similar components are labelled similarly to FIG. 1*a*. FIG. 5 includes washing machine 12 with washing drum 13, reservoirs 14*a*-14*e*, monitoring devices 18*a*-18*e*, management system 20 and product source 22.

FIG. 5 operates as described in relation to FIG. 1, only in this embodiment, reservoirs 14*a*-14*e* are distributed. Reservoirs 14*a*-14*b* are located within washing machine 12, and fluidly connect to washing drum 13 for dispensing components from the reservoirs to drum 13.

Reservoir 14*c* is located directly in drum 13. This can be a secure connection to a side of the drum, or reservoir could simply be free to move within drum and dose the one or more components inside as needed. Reservoir 14*c* could be the reservoir shown and described in relation to FIG. 4, which has a controller and possible power source for independent power and communication with management system 20. When management system 20 determines a replenishment is needed for reservoir 14*c*, a user could be prompted to simply remove reservoir 14*c* from the washing machine and insert a replacement one (and possibly remove the controller and connect it to the replacement reservoir).

Reservoirs 14*d*-14*e* are located outside of washing machine 12, and fluidly connected to washing machine 12. This may be convenient when washing machine 12 is compact, and has a limited amount of space within the washing machine 12. By allowing for use of one or more reservoirs from outside the washing machine 12 to be fluidly connected for use with laundry system 10, a larger variety of laundry components could be used, making it possible to have more personalized laundry products no matter the size or type of washing machine 12 used.

While a number of options, for example, related to reservoirs, monitoring devices, sensing methods, etc., were discussed in relation to various embodiments, such options would also be available to other embodiments. For example, the different options for reservoirs and/or insertable cartridges or pouches could be used with the system of FIG. 5 though predominantly discussed in relation to the system of FIG. 1.

While management system 20 is shown as a remote system, in some embodiments, management system 20 could be part of the washing machine 12, user interface 19, and/or even at the product source 22. Communication between devices and system of laundry system 10 can be through any communication network, wired or wireless.

Chambers within reservoirs could hold many different components, including fluid components, gases, vapours, ullage, etc., or any other component which could be used in combination with a wash process.

Concepts are described with reference to schematic illustrations and block diagrams of systems and computer program goods that can be embodied as hardware, software or a combination. Any suitable computer program code could be used and executed on any suitable machine, at a location of a wash machine or remotely. The computer program instructions may be stored in a non-transitory computer readable medium that can direct a computer, other programmable data processor or other device to function in a particular manner as outlined in the concepts herein.

It is to be understood that the examples and embodiments described herein are for illustrative purposes and that various modifications or changes in light thereof will be suggested to a person skilled in the art and are included in the spirit and scope of the invention and the appended claims.

The invention claimed is:

1. A method comprising:

supplying a laundry dosing system with one or more reservoirs providing one or more components for laundry;

monitoring consumption of each of the components in the one or more reservoirs;

automatically determining from the monitoring when each of the one or more reservoirs need replenishment;

wherein the step of automatically determining when each of the one or more reservoirs need replenishment from the monitoring comprises:

monitoring the amount of the component in each of the one or more reservoirs;

analyzing whether the amount of the component in each of the one or more reservoirs is below a certain threshold amount; and generating a replenishment signal associated with a specific reservoir of the one or more reservoirs when the component in that reservoir is below the threshold amount;

replenishing the one or more components in response to a monitoring result;

wherein the step of replenishing one or more components in response to a monitoring result comprises automatically ordering one or more components in response to a monitoring result;

applying one or more monitoring devices to the one or more reservoirs;

analyzing whether the component in each of the one or more reservoirs needs replenished based on expiration and/or contamination of the component or the reservoir; and generating a replenishment signal associated with the specific reservoir of the one or more reservoirs when the component in that reservoir is expired and/or the component or reservoir is contaminated.

2. The method of claim 1, and further comprising:

emptying the remaining components from the specific reservoir of the one or more reservoirs when the component in that reservoir is expired and/or the component or reservoir is contaminated.

3. The method of claim 1, and further comprising collecting data regarding usage of each component.

4. The method of claim 3, and further comprising associating collected data with a user or household profile to analyze usage patterns and predict future replenishment needs.

* * * * *